United States Patent [19]

Hagan et al.

[11] Patent Number: 4,909,289

[45] Date of Patent: Mar. 20, 1990

[54] FILLING AND DISPENSING VALVE WITH DROP-AWAY VALVE MEMBER

[75] Inventors: Richard J. Hagan, San Carlos; John McIntyre, Foster City; Michael Clausen, Santa Clara, all of Calif.

[73] Assignee: Jopado Baderi, Santa Clara, Calif.

[21] Appl. No.: 73,279

[22] Filed: Jul. 2, 1987

[51] Int. Cl.[4] ..... B65B 83/00

[52] U.S. Cl. ..... 141/302; 222/400.7; 222/400.8; 137/312; 137/322; 141/348

[58] Field of Search ..... 141/65, 59, 113, 348–350, 141/285, 291–295, 301, 302, 305, 306, 310, 329; 222/400.7, 400.8; 220/86 NR; 137/212, 322

[56] References Cited

U.S. PATENT DOCUMENTS

| | | | |
|---|---|---|---|
| Re. 32,354 | 2/1987 | Savage | 222/81 |
| 3,195,569 | 7/1965 | Seaquist | 137/553 |
| 3,390,820 | 7/1968 | Marraffino et al. | 222/635 |
| 3,473,556 | 10/1969 | Johnson et al. | 137/322 |
| 3,473,704 | 10/1969 | O'Donnell | 222/402.16 |
| 3,669,313 | 6/1972 | Marand et al. | 222/95 |
| 3,746,059 | 7/1973 | Mizuguchi | 141/295 |
| 3,800,979 | 4/1974 | Piffath et al. | 137/322 X |
| 3,871,422 | 3/1975 | Elson et al. | 137/231 |
| 4,142,658 | 3/1979 | Golding | 222/400.7 |
| 4,150,771 | 4/1979 | Golding | 222/400.7 |
| 4,193,576 | 3/1980 | White | 251/149.6 |
| 4,312,349 | 1/1982 | Cohen | 141/329 X |
| 4,450,853 | 5/1984 | Dessenoix et al. | 137/212 |
| 4,509,663 | 4/1985 | Fallon | 222/400.7 |
| 4,715,414 | 12/1987 | Harrison et al. | 141/302 |
| 4,756,347 | 7/1988 | Hagan et al. | 141/21 |

FOREIGN PATENT DOCUMENTS

| | | | |
|---|---|---|---|
| 617075 | 3/1961 | Canada | 141/329 |

*Primary Examiner*—Ernest G. Cusick

*Attorney, Agent, or Firm*—Flehr, Hohbach, Test, Albritton & Herbert

[57] ABSTRACT

A valve (20) has a valve housing (22) with a central passage (28) extending axially through the valve housing (22). Aperture (40) in the valve housing connect a second passage (38) to the central passage (28) to extend through the valve housing. A poppet valve member (24) is configured for sealing engagement of the central passage (28). The valve member (24) is urged into sealing engagement with the central passage (28) by internal pressure in a container (36) on which the valve (20) is provided. The valve member (24) and the valve housing (22) are configured so that the valve member (24) will drop away from sealing the central passage (28) when the pressure in the container (36) is insufficient to hold the valve member (24) in sealing position against the central passage (28) to leave the valve (20) in a permanently open state. An annular valve member (26) seals the second passage (38) in the same manner.

17 Claims, 10 Drawing Sheets

FILLING AND DISPENSING VALVE WITH DROP-AWAY VALVE MEMBER

ORIGIN OF INVENTION

This application covers an improvement to the invention shown and described in our copending, commonly assigned application Ser. No. 06/820,400, filed Jan. 17, 1986 and entitled "Filling and Dispensing Valve, Adapter and Package" now U.S. Pat. No. 4,756,347.

BACKGROUND OF THE INVENTION

1. Field of the Invention

This invention relates to an improved valve of the general type described in the above related application, in which the valve is used both for filling a container with liquid and for dispensing the liquid from the container. More particularly, it relates to a valve of this type in which multiple flow paths used during the filling and the dispensing are formed from parts having a simplified construction, compared to the specific form of the valves shown in the above application.

2. Description of the Prior Art

The extensive prior art on valves used in packages for liquid products is summarized and of record in the above related application. The shortcomings of earlier valve designs for potential alternative packages for draft beer to the traditional keg led to the development of the beer valves described in the related application. While the multiple flow path beer valve designs shown in the related application have been found to be highly suitable for their intended purpose, further development has been found desirable in order to make valves of this general type similar in design, easier to fabricate in high volume production, and therefore lower in cost.

SUMMARY OF THE INVENTION

Accordingly, it is an object of this invention to provide a multiple flow path filling and dispensing valve for a liquid that is especially suited for fabrication in high volume production.

It is another object of the invention to provide such a multiple flow path filling and dispensing valve which incorporates an improved technique for sealing at least one of the multiple flow paths after filling and for opening the at least one flow path for dispensing the liquid from a container on which the valve is used.

It is a further object of the invention to provide such a multiple flow path filling and dispensing valve incorporating an improved way for locking the valve open for dispensing and after the container is empty which will allow the valve to be opened more than once before it is permanently locked open.

The attainment of these and related objects may be achieved through use of the novel valve and package incorporating the valve herein disclosed. A valve in accordance with this invention has a valve housing with a central passage extending axially through the valve housing. Means is provided in the valve housing for forming a second passage extending through the valve housing. A valve member is configured for sealing engagement of the central passage. The valve member is configured so that the valve member is urged into sealing engagement with the central passage by internal pressure in a container on which the valve is provided. The valve member and the valve housing are configured so that the valve member will drop away from the central passage when the pressure in the container is insufficient to hold the valve member in sealing position against the at least one of the central and second passages to leave the valve in a permanently open state.

In another aspect of the invention, a filling and dispensing valve includes a valve housing having a central passage extending axially through the valve housing. A means is provided in the valve housing for forming a second passage extending through the valve housing. A valve member is configured for sealing engagement of the central passage. The valve member is configured so that the valve member is urged into sealing engagement with the central passage by internal pressure in a container on which the valve is provided. The valve member has at least one flexible, flared projection extending laterally from the valve member and away from an end of the valve configured for placement inside a container. The flexible, flared projection is configured to engage a wall of the central passage in the sealing engagement up to a given pressure in the container and to flex away from the wall at a pressure greater than the given pressure.

The attainment of the foregoing and related objects, advantages and features of the invention should be more readily apparent to those skilled in the art, after review of the following more detailed description of the invention, taken together with the drawings, in which:

DETAILED DESCRIPTION OF THE PREFERRED EMBODIMENT

Figure 1:
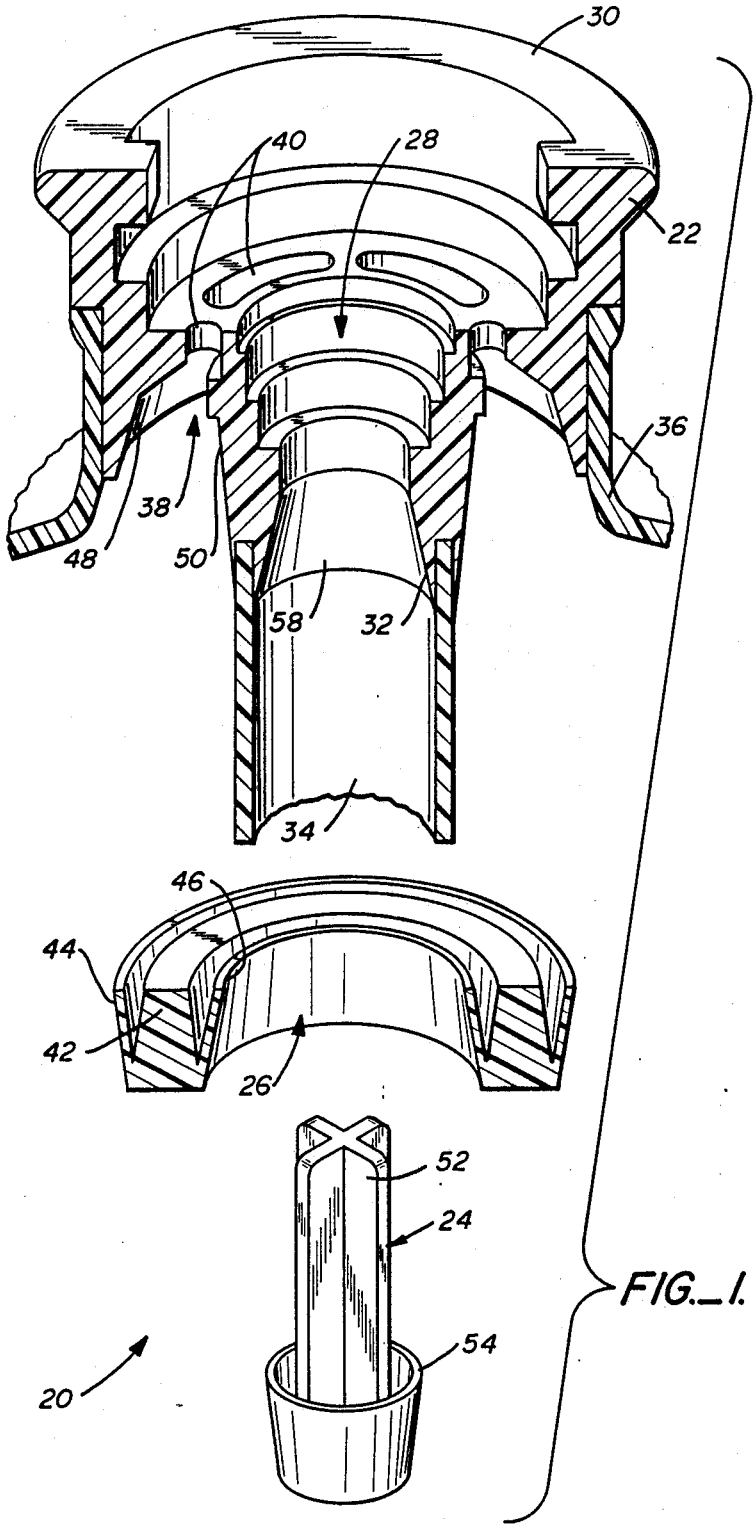
FIG. 1 is an exploded, partial cross section and perspective view of a first valve in accordance with the invention.

Turning now to the drawings, more particularly to FIGS. 1–4, there is shown a valve 20 in accordance with the invention. The valve 20 has three parts: a valve housing 22, a poppet type valve member 24 and an annular valve member 26. These parts are advantageously fabricated from a suitable molded plastic material, such as an injection molded co-polyester plastic. Similarly, the parts of the other examples of valves described below are also advantageously formed by injection molding of a co-polyester plastic.

Valve housing 22 has a centrally disposed, axial passage 28 extending from its top 30 through the housing 22 and terminating in a flanged end 32. A down tube 34 is attached to the flanged end 32 of the housing 22, such as by a press fit, ultrasonic bonding or spin welding, and extends from the flanged end 32 down to the bottom of a container 36 (FIG. 2) on which the valve 20 is mounted. The poppet valve member 24 is positioned within the passage 28 when the valve 20 is closed (see FIG. 3). The poppet valve member 24 has a cruciform cross section rod 52 and a flared projection 54 extending laterally and upwardly from base 56. The flared projection 54 engages wall 58 of the passage 28 to seal the passage 28 when the valve 20 is closed. A branch passage 38 is connected to the passage 28 by circumferential openings 40 around the passage 28. The annular valve member 26 fits into the branch passage when the valve is closed (see FIG. 3). The annular valve member 26 has a ring portion 42 and flared projections 44 and 46 extending laterally and upwardly from the ring portion 42. As is best shown in FIG. 3, the flared projections 44 and 46 engage opposing walls 48 and 50 of the valve housing 22 which define the branch passage 38 when the valve is closed.

Figure 2:
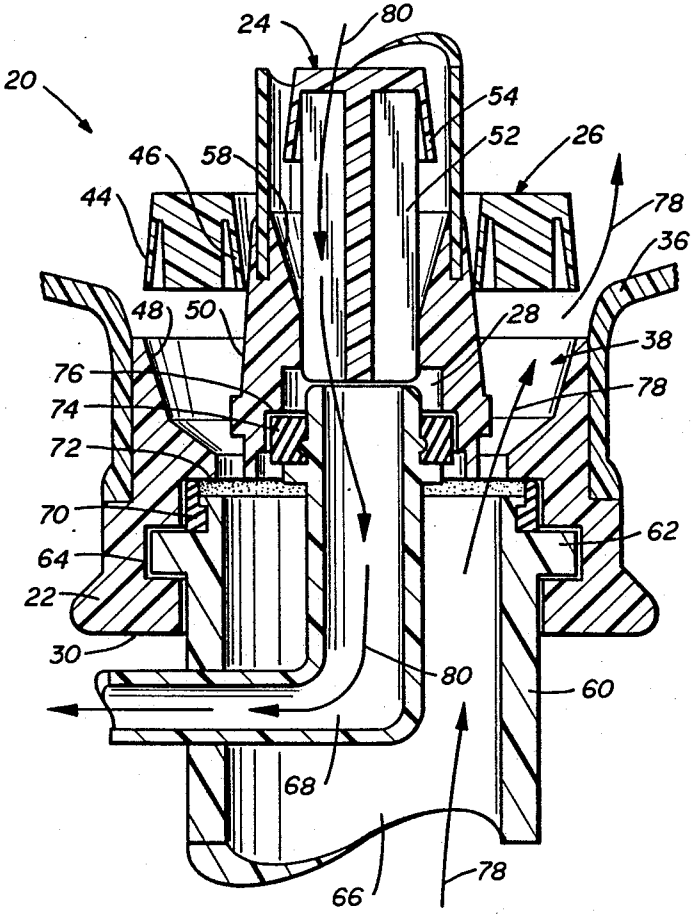
FIG. 2 is a cross-section view of the valve of FIG. 1 during filling of a container including the valve.

FIG. 2 shows the valve 20 during filling of the container 36 on which the valve 20 is mounted. Filling is carried out with the container 36 inverted. A filling head 60 is inserted into the passage 28 from top 30 of the valve housing 22. A bayonet fitting 62 engages recess 64 on the housing 22. The filling head has an outer tube 66 through which beer flows into the container 36 and an inner tube 68 through which air flows out of the container 36 as the beer fills the container 36. Outer tube 66 has a gasket 70 which engages projection 72 of the housing 22 to seal the outer tube 66 against the housing 22. Inner tube 68 extends beyond the outer tube 66 to engage rod 52 of the poppet 24 when the filling head 60 is in place in the passage 28, thus moving the poppet upward as shown to displace the projection 54 away from the wall 58. A gasket 74 on the inner tube 68 engages the housing 22 at 76 to seal the inner tube 68 against the housing 22. When beer is supplied to the outer tube 66 for filling the container 36, the pressure of the beer in the branch passage 38 lifts the annular valve member 26 so that the flared projections 44 and 46 are no longer engaging walls 48 and 50 of the branch passage 38. This opens a flow path 78 for the beer through the branch passage 38 and into the container 36. As the beer fills the container 36, air trapped in the container 36 is forced out of the container 36 in a second flow path 80 through the central passage 28. When the container 36 has been filled, it is has an internal pressure of about 15 p.s.i. The flow of beer into the container 36 is turned off, the annular valve member 26 settles into sealing position (see FIG. 3), and the filling head 60 is removed simultaneously with righting the container 36. The internal pressure of the beer and any remaining trapped air inside the container 36 keeps the annular valve member in sealing position and causes the poppet 24 to move into sealing position in the central passage 28 as the filling head 60 is withdrawn from the passage 28. The valve 20 on the filled container 36 then has its valve members 24 and 26 in the positions shown in FIG. 3.

Figure 3:
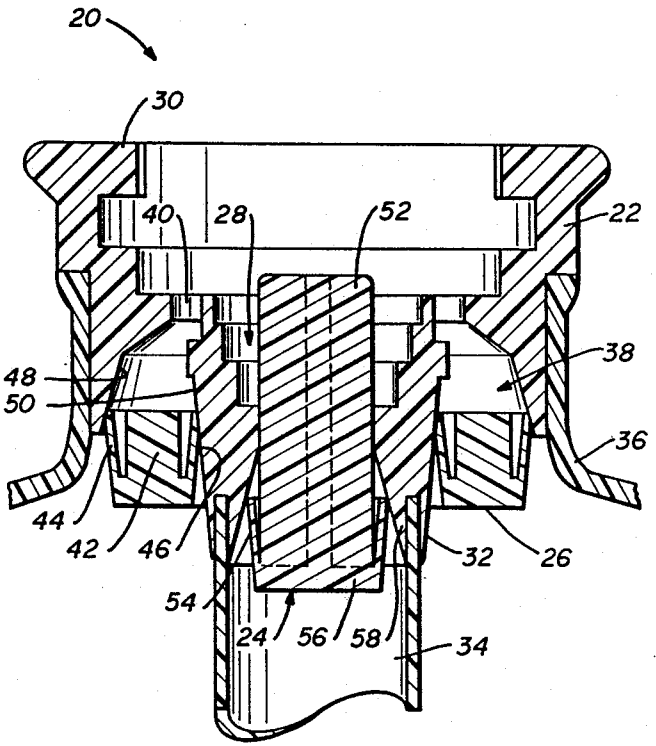
FIG. 3 is another cross-section view of the valve in FIGS. 1 and 2, showing position of its parts after filling of the container has been completed and prior to dispensing liquid from the container through the valve.

The configuration of the projections 44 and 46 on the annular valve member 26 and the projection 54 on the poppet 24 provide an important safety feature in the valve 20 when the valve is in its sealed position as shown in FIG. 3. At the pressures normally employed with draft beer, e.g., about 15 p.s.i., the projections 44, 46 and 54 provide an effective seal in the valve 20. As the pressure increases up to a certain level the seal becomes even more effective as the projections 44, 46 and 56 are pressed tighter against their mating walls 48, 50 and 58. Above about that level flexibility of the projections 44, 46 and 54 allows a blow-by effect to occur for the relief of excess pressure. When the excess pressure has dropped sufficiently, an effective seal is once again created. The pressure at which the blow-by effect takes place is dependent on the thickness and flexibility of the projections 44, 46 and 56, and can be adjusted with different thicknesses and/or materials for the projections.

Figure 4:
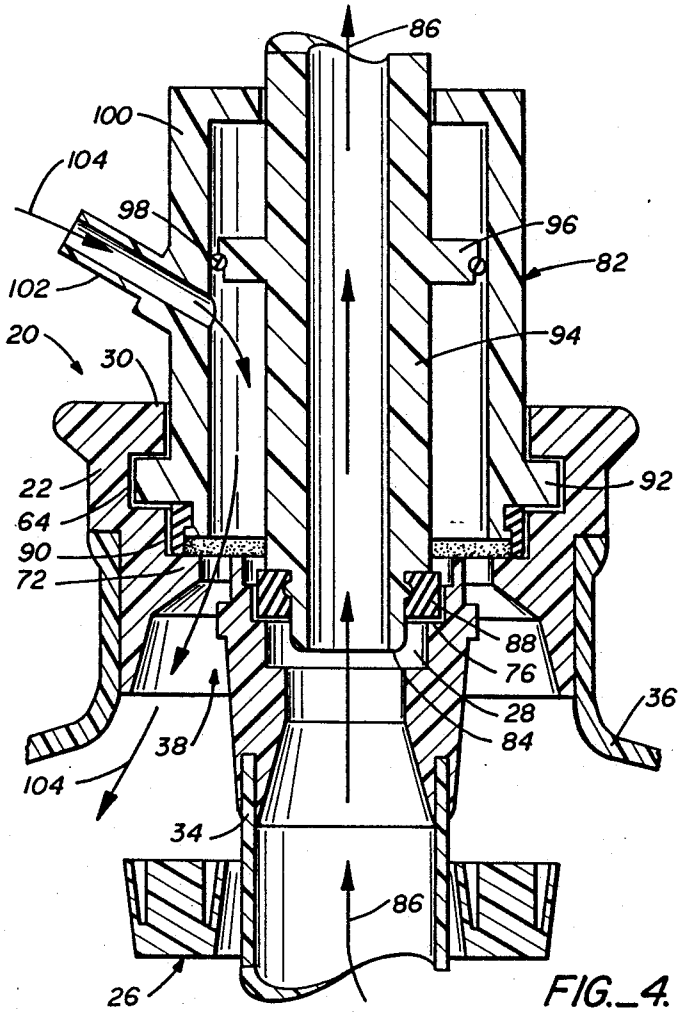
FIG. 4 is a further cross-section view of the valve in FIGS. 1–3, but while dispensing liquid from the container through the valve.

FIG. 4 shows the valve 20 during dispensing of the beer from the container 36. A tapper 82 is inserted into the valve 20 from its top 30. End 84 of the tapper 82 extends into the passage 28 to dislodge the poppet 24 (not shown), causing it to fall to the bottom of the down tube 34 and allowing an initial flow of beer from the container 36 in flow path 86. A spigot (not shown) is provided at the upper end of the flow path 86 for controlling flow of the beer from the container 36. As in the case of the filling head 60, the tapper 82 has a gasket 88 which seals against the passage 28 at 76 and a gasket 90 which seals against projection 72 on the valve housing 22. Bayonet fitting 92 engages recess 64 on the housing 22. Inner beer flow tube 94 of the tapper has a flange 96 with an O-ring 98 in sealing engagement against housing 100 of the tapper 82. An air inlet 102 extends through the housing 100 below the flange 96. When air is supplied through the inlet 102 at a pressure greater than the internal pressure of the container 36, it blows the annular valve member 26 out of sealing engagement with the branch passage 38. The annular valve member 26 then falls to the bottom of the container 36, and both air flow path 104 and beer flow path 86 of the valve 20 are permanently open. When the beer has been emptied from the container 36, the tapper 82 is removed. Because the air and beer flow paths 104 and 86 of the valve 20 remain open when this is done, there is no danger of excessive pressure building up in container 36 when it is crushed for recycling.

Figure 5:
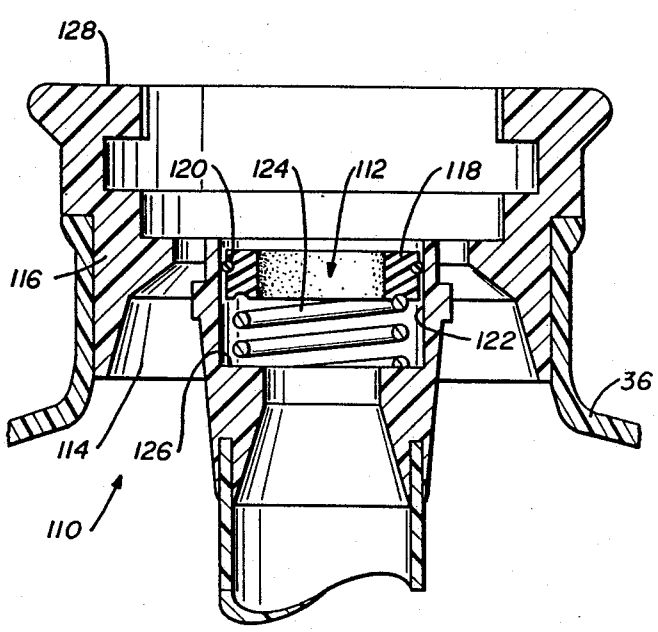
FIG. 5 is a cross-section view of a second valve in accordance with the invention.

FIG. 5 shows another valve 110 incorporating a central passage 112 and a branch passage 114 in valve housing 116. A gasket 118 in the central passage 112 has an O-ring 120 in sealing engagement against wall 122 of the central passage 112. A spring 124 extends between the gasket 118 and step 126 in the central passage. The gasket 118 engages an end of a tapper (not shown) when the tapper is inserted in top 128 of the valve housing 116. The spring loaded gasket 118 allows the valve 110 to be used with common commercially available tappers. A poppet and an annular valve member having the same configuration as the poppet 24 and annular valve member 26 of the FIGS. 1–4 embodiment completes the valve 110. Other than as shown and described, the construction and operation of the valve 110 is the same as the valve 20 of the FIGS. 1–4 embodiment.

Figure 6:
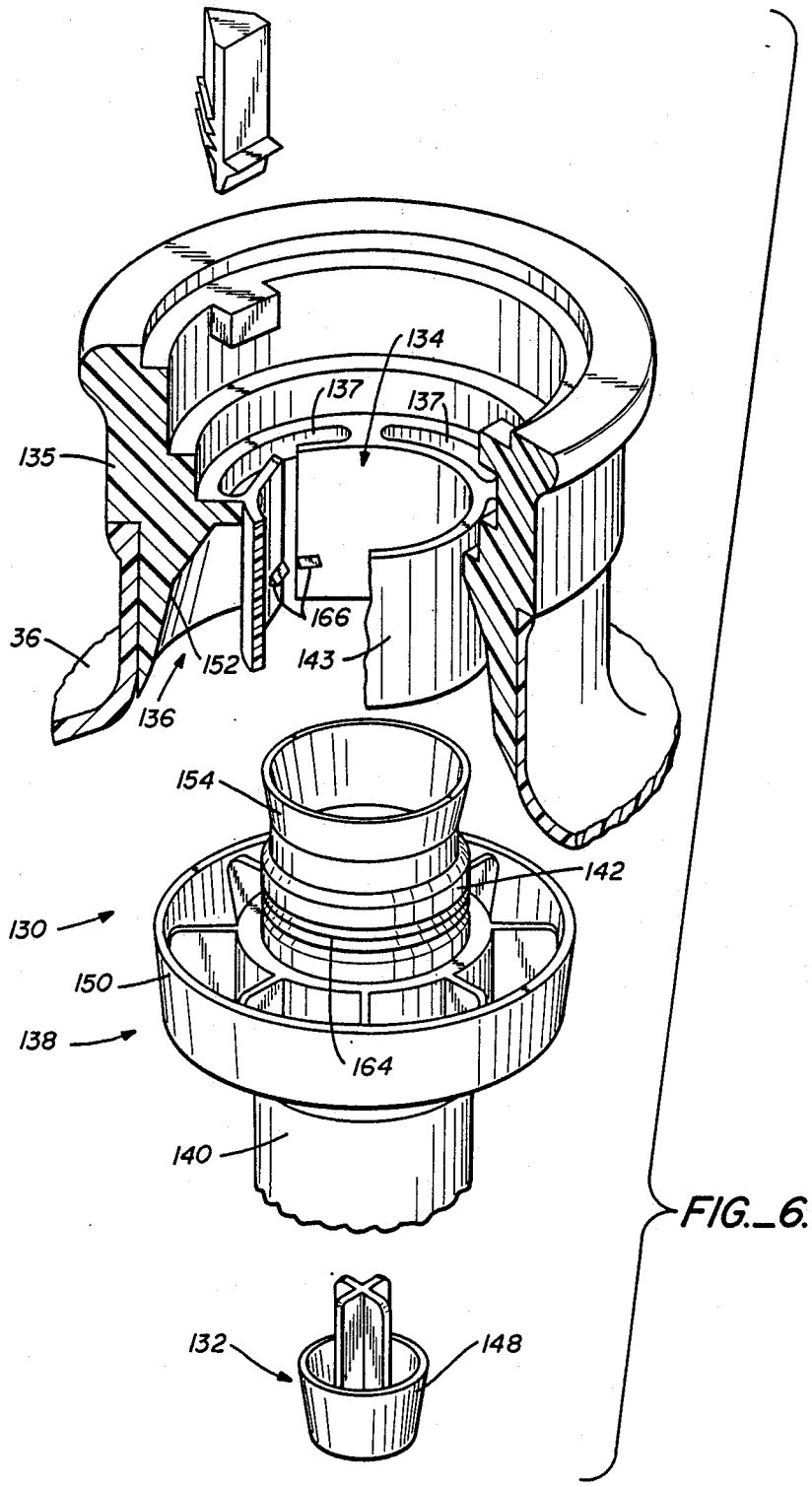
FIG. 6 is an exploded cross-section view in partial section of a third valve in accordance with the invention.
Figure 6A:
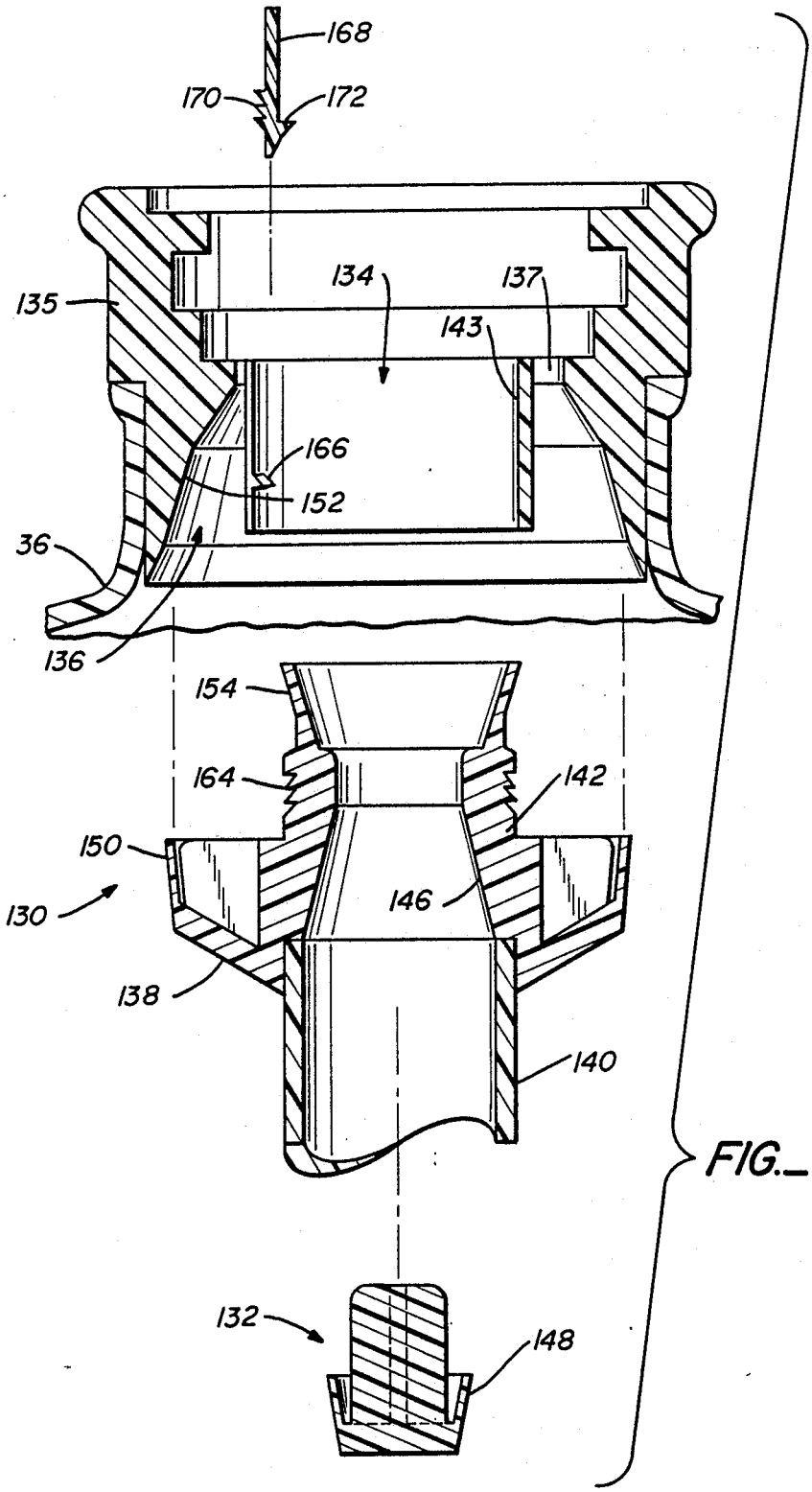
FIG. 6A is an exploded cross-section view of the valve in FIG. 6.
Figure 8:
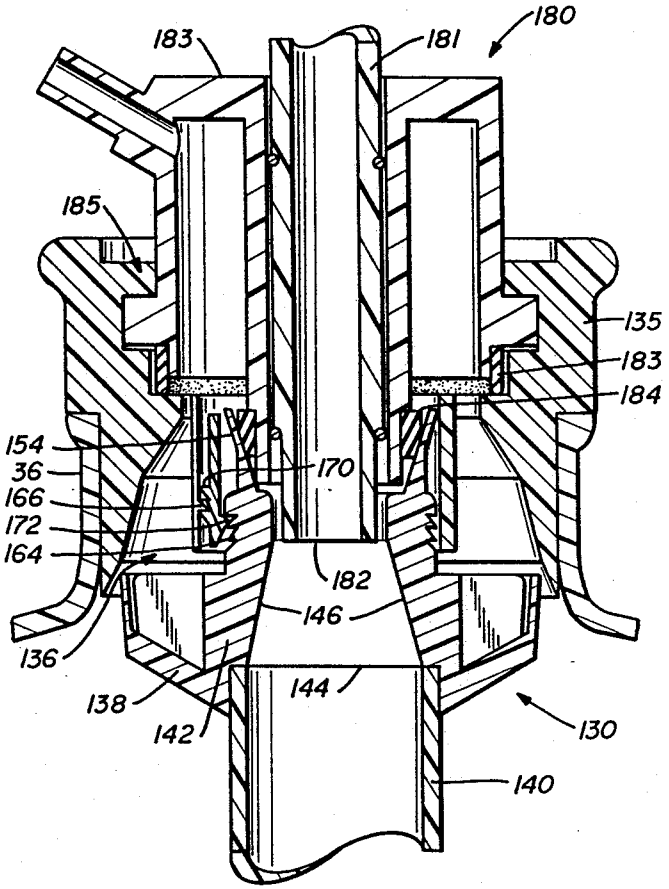
FIG. 8 is a cross-section view of the valve in FIGS. 6–7B, but in the open position.
Figure 7:
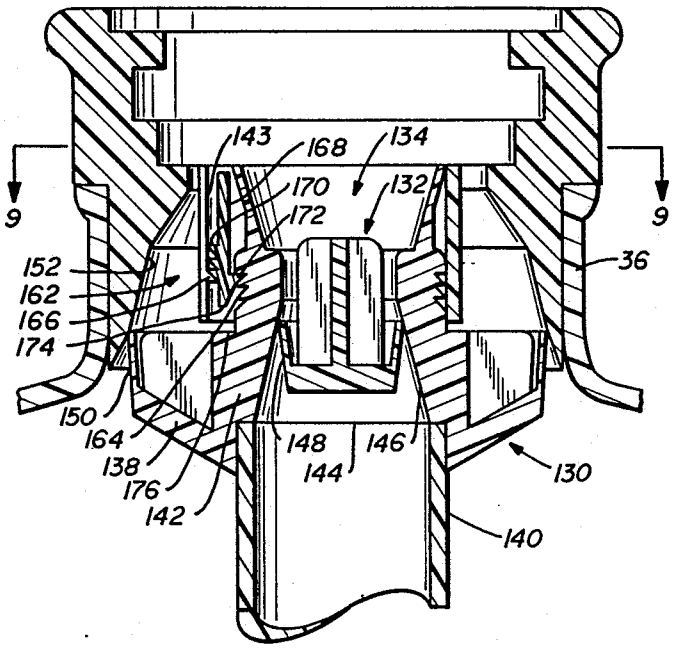
FIG. 7 is an assembled cross-section view of the valve in FIGS. 6 and 6A when sealed.

FIGS. 6–8 show another beer filling and dispensing valve 130 having a poppet 132 in a central passage 134 of a valve housing 135, a branch passage 136 connected to the central passage 134 by centrifugal apertures 137, and a sealing member 138 for the branch passage 136 configured as a flange for down tube 140. The flange sealing member 138 has a portion 142 extending above the down tube 140 into cylinder 143 and defining the central passage 134 in part. The poppet 132 has a projection 148 extending laterally and upwardly to engage the inclined wall 146 to seal the central passage when pressure inside the container 36 forces the poppet 132 upward in the portion 142. Similarly, flange sealing member 138 has a projection 150 extending laterally and upwardly to engage wall 152 of the branch passage 136. The projections 148 and 150 interact with their mating surfaces 146 and 152 in the same manner as the projections 44, 46 and 54 and their mating surfaces 48, 50 and 58 in the FIGS. 1–4 embodiment to provide effective sealing up to a certain pressure and blow-by pressure relief above that pressure.

The valve 130 incorporates a ratchet mechanism 162 (FIG. 7) which allows the valve 130 to be opened and closed more than once before the ratchet mechanism 162 keeps the valve 130 permanently open. Flange sealing member 138 attached to down tube 140 has the portion 142 extending above the down tube 166 to define central passage 134 in the housing 172 part. The portion 142 has a plurality of ratchet teeth 164 extending circumferentially around the portion 142 below projection 154. Cylinder 143 has a pair of pawls 166. A wedge 168 (see also FIGS. 9A–9D) is inserted between the teeth 164 and pawls 166. The wedge 168 has ratchet teeth 170 which engage the pawls 166 and a pawl 172 which engages the ratchet teeth 164. It can be seen that the ratchet teeth 164 and 170 and the pawls 166 and 172 form back-to-back ratchet and pawl mechanisms. These back-to-back ratchet and pawl mechanisms operate to advance the wedge 168 downward each time the valve 130 is opened and closed, until bottom 174 of the wedge 168 bottoms out on surface 176, at which time the valve 130 remains in a permanently open position for pressure relief. This mode of operation can be better understood by following the sequence of operation shown in FIGS. 7–8B.

FIG. 7 shows the valve 130 in its sealed position, after assembly and before the container 36 has been filled with beer. In assembly, the wedge 168 is driven between the portion 142 and the ring 143 opposite pawl 166 until pawl 172 engages the first tooth 164 on the portion 142. For the valve to be in the position shown in the absence of internal pressure in the container 36 for holding the poppet 132 in its sealed position, the container 36 needs to be in an inverted position, so that gravity will hold the poppet 132 in the position shown.

For testing operation of the valve 130, it is opened for the first time to the position shown in FIG. 8. A testing head 180, which may be a tapper as shown, pushes down on the projection 154 to move the flange sealing member 138 and down tube 140 to the position shown. Tube 181 is inserted in housing 183 of the testing head until end 182 of the tube 181 pushes down on the poppet 132 to dislodge it from the inclined surface 146, and it falls to the bottom of the down tube 140. The pawl 166 moves over the first tooth 170 on the wedge 168, as can be seen by comparing FIGS. 7 and 8. A bayonet fitting at 185 secures the head 180 in place, and gasket 187 forms a seal with the valve housing 135. Gasket 184 separates the central passage 134 from the branch passage 136. Air is then introduced into the container 36 from air inlet 186 through branch passage 136 and flow through the down tube and out of the container 36 is checked. With the tube 181 in place, even though the air flow will raise the poppet against end 182, the valve remains open. To test sealing of the poppet 132 against surface 146, the tube 181 is raised in housing 183 until projection 148 of the poppet 132 is allowed to move into sealing engagement against the surface 146.

Figure 7A:
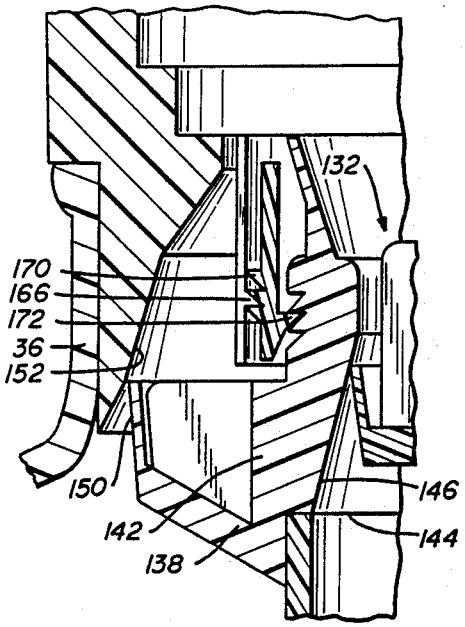
FIGS. 7A and 7B are additional assembled cross-section views of the valve in FIGS. 6–7, but in later stages of operation.

When the testing has been completed, the head 180 is removed from the valve 130. Positive pressure inside the container 36 returns the flange sealing member 138 with the projection 150 in sealing engagement against inclined surface 152. The pawl 172 on wedge 168 moves over the first tooth 164 on portion 142 during the upward movement of the flange 138 (compare FIGS. 8 and 7A).

Figure 8A:
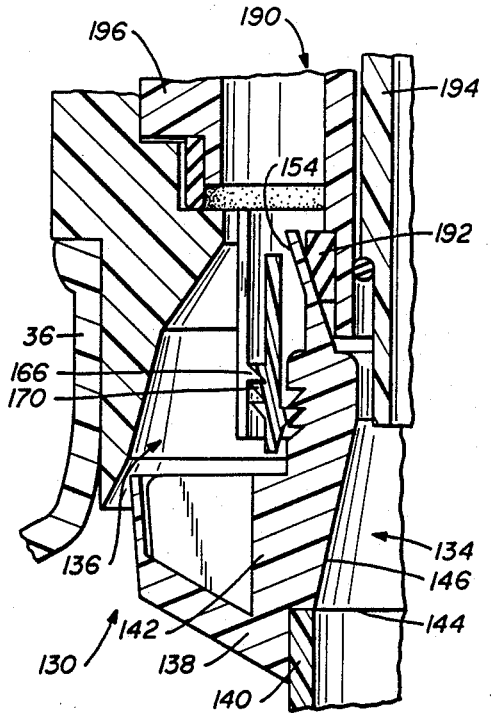
FIGS. 8A and 8B are additional cross-section views of the valve in FIGS. 6–8 in the open position, but in later stages of operation.

For filling the container, as shown in FIG. 8A, a filling head 190 is attached to the valve 130 in the same manner as the testing head 180. Gasket 192 seals the central passage 134 from the branch passage 136. The filling head pushes down on the projection 154 to move the flange 138 down, opening branch passage 136. This movement advances pawl 166 over the second tooth 170 (compare FIGS. 8A and 7A). Tube 194 is lowered in housing 196 to push down on poppet 132, which falls to the bottom of down tube 140. The beer flows into the container 36 through branch passage 136 and the air in the container is expelled through the down tube 140 and central passage 134. The poppet moves upward in the down tube 140 with the air flow, but is prevented from sealing the central passage 134 by the tube 194. The container 36 can be filled either right side up or inverted with the valve 130. When the container 36 has been filled, the tube 194 is raised in housing 196 to allow the poppet 132 to seal the central passage 134.

Figure 7B:
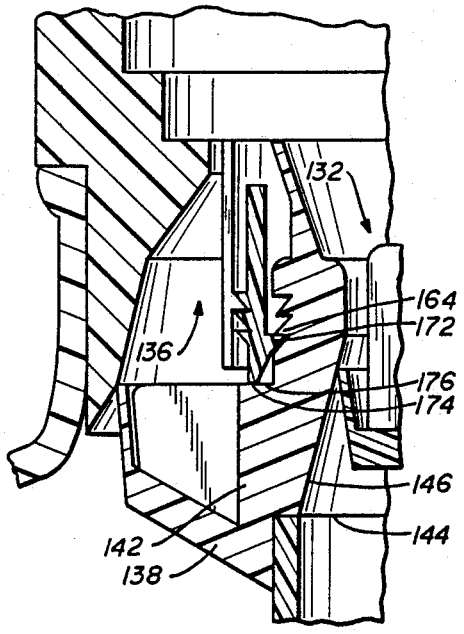

When the filling head 190 is removed, positive pressure in the container 36 returns the flange sealing member 138 to the sealed position shown in FIG. 7B, again sealing the branch passage 136. Pawl 172 moves over the bottom tooth 164 during this movement (compare FIGS. 7B and 8A). Note that bottom 174 of the wedge 168 engages surface 176 of the flange sealing member 138 for the first time.

Figure 8B:
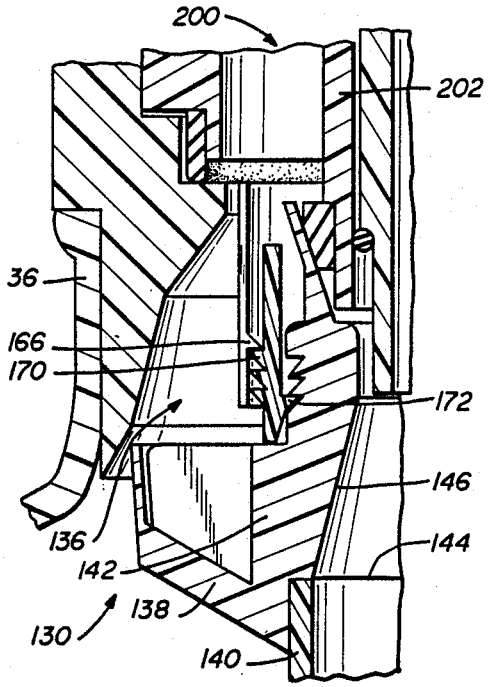
Figure 9:
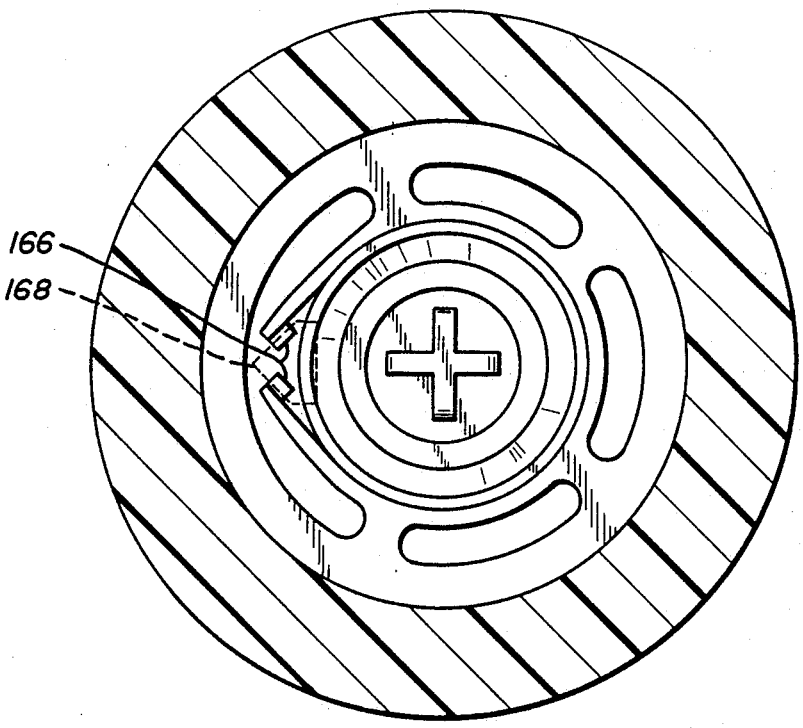
FIG. 9 is a cross-section plan view of the valve in FIGS. 6–8B.
Figure 9A:
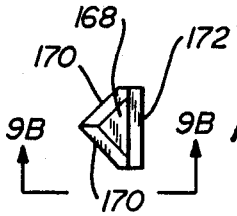
FIG. 9A is a top plan view of a portion of the valve in FIGS. 6–9.
Figure 9B:
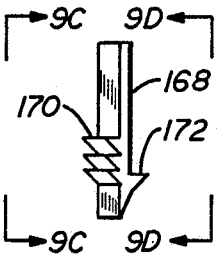
FIG. 9B is a side elevation view of the valve portion shown in FIG. 9A.
Figure 9C:
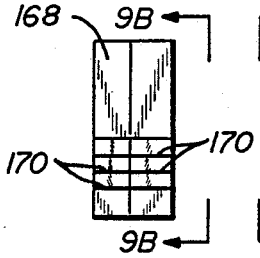
FIGS. 9C and 9D are side views of the valve portion shown in FIGS. 9A and 9B.
Figure 9D:
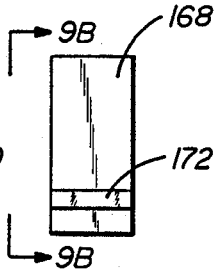

FIG. 8B shows the final actuation of the valve 130 for dispensing beer from the container 36. A tapper 200 is attached to the valve 130 in the same manner as the testing head 180 and the filling head 190. Downward force on the flange sealing member 138 moves the flange and down tube 140 down, opening the branch passage 136. During this downward movement, pawl 166 moves over the top tooth 170 on the wedge 168. The pawls 166 and 172 now lock the flange and down tube 140 in the position shown. Tube 202 pushes down on the poppet 132 to open the central passage 134, and beer may flow out of the container 36. The tube 202 prevents poppet 132 from being raised to sealing position by the beer flow. For dispensing beer from the container 36, air or carbon dioxide is supplied under pressure through the branch passage 136 by the tapper 200, and the beer flows out through the down tube 140 and central passage 134. When the container is empty, the tapper 200 is removed, and the flange sealing member 138 remains locked in the open position as shown by the wedge 168. Pressure buildup is thus avoided in the container 36 when it is crushed for recycling. Other than as shown and described, the construction and operation of the FIGS. 6–8B embodiment is the same as that of the FIGS. 1–4 embodiment.

Figure 12:
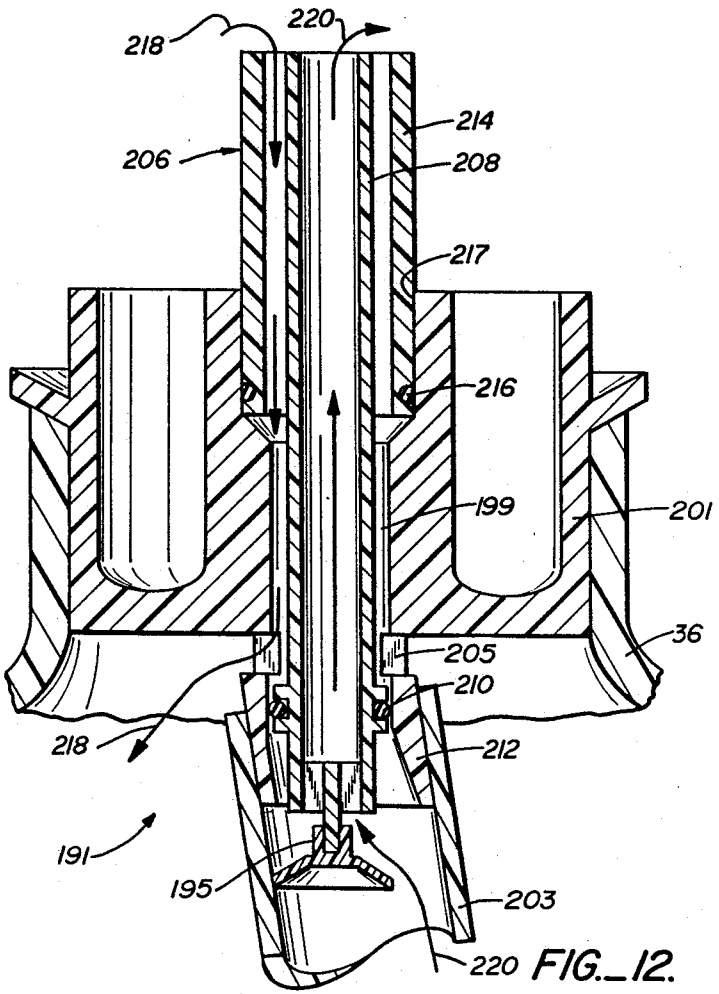
FIG. 12 is a cross-section view of the valve in FIGS. 10 and 11, but while dispensing liquid from a container in which the valve is used.
Figure 11:
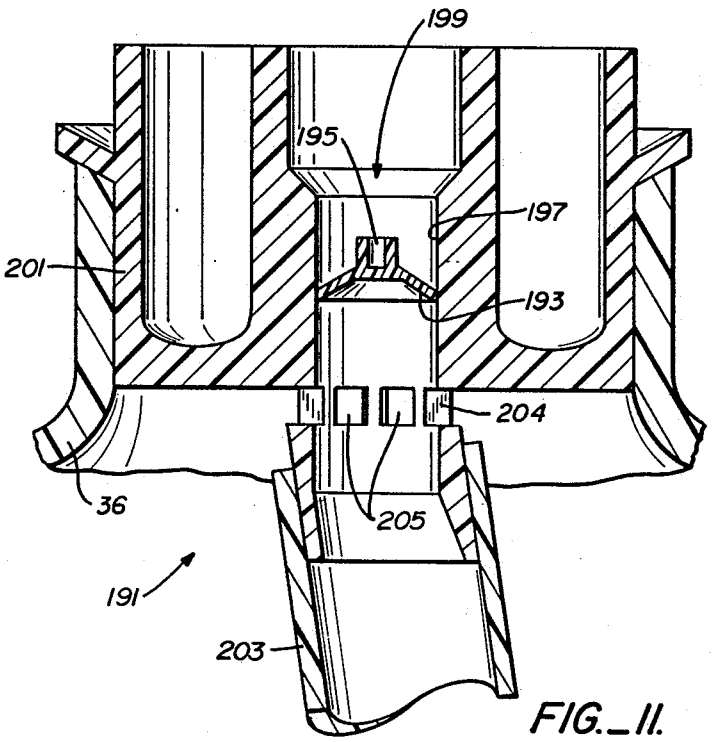
FIG. 11 is a cross-section view of the valve in FIG. 10 when sealed.
Figure 10:
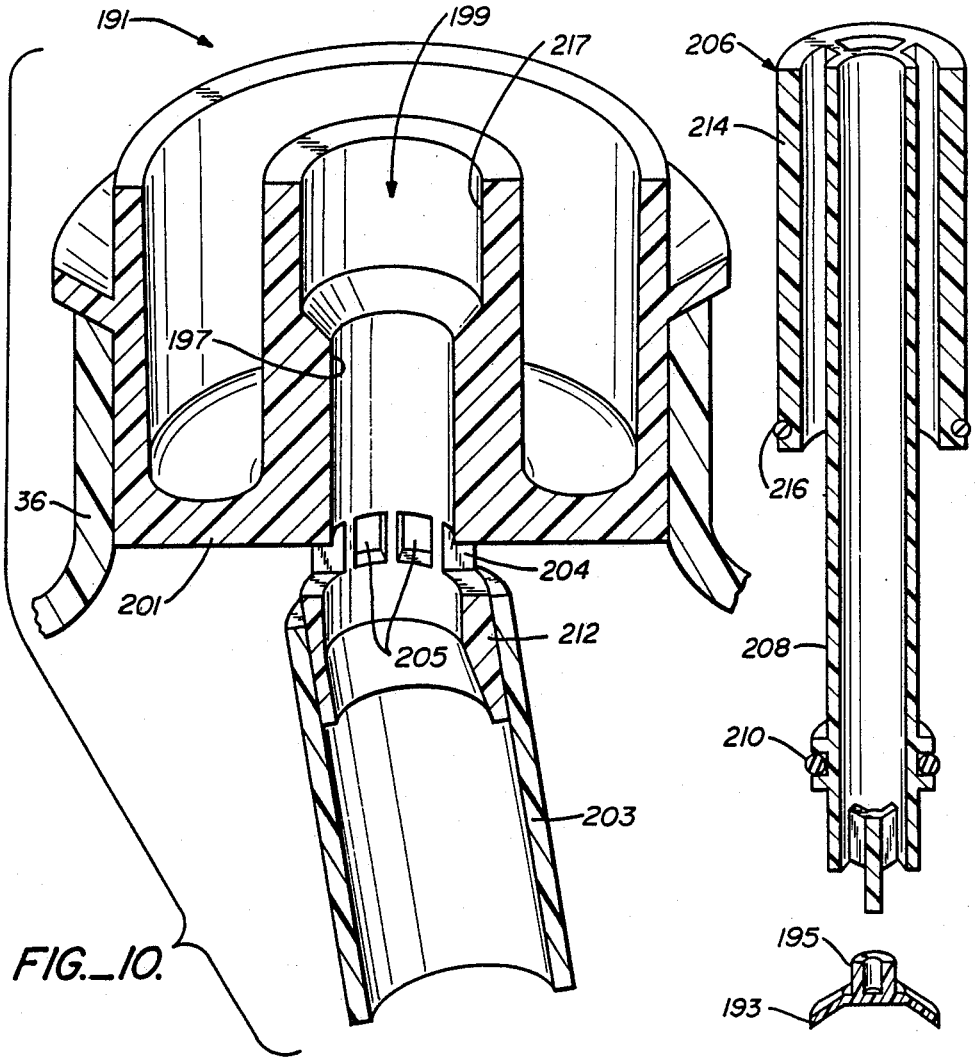
FIG. 10 is an exploded cross-section view of a fourth valve in accordance with the invention.
Figure 13:
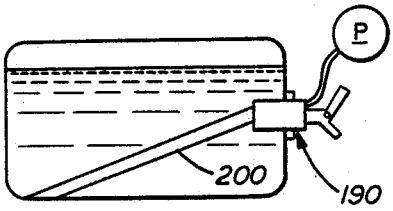
FIG. 13 is a side view of a package incorporating the valve of FIGS. 10–12.

FIGS. 10–12 show a valve 191 having one moving part, in the form of a poppet 195 with a flange sealing member 193 which engages inclined wall 197 of central passage 199 extending through housing 201 when the valve 191 is closed. As in the case of the FIGS. 1–4 embodiment, the container 36 using the valve 191 must be filled in the inverted position. The valve 191 has a canted down tube 203, which reaches the lowest point of the container 36 when the container 36 is resting on its side, such as when it is placed in a refrigerator for dispensing beer without removing the container from the refrigerator, as shown in FIG. 13. Central passage 199 has apertures 205 extending through wall 204 above the down tube 203. FIG. 11 shows the valve 191 in its sealed position, with poppet 195 held in place with flange 193 in sealing engagement against the inclined wall 197 by the internal pressure of about 15 p.s.i. in the container 36 after it has been filled with beer. FIG. 12 shows the valve 191 after installation of a tapper 206 for dispensing the beer from the container 36. The tapper 206 has an inner tube 208 with an O-ring 210 which is inserted past the apertures 205 and seals against fitting 212 for the down tube 203. The tapper 206 has an outer tube 214 with an O-ring 216 that seals against wall 217 of the central passage 199. An air flow path 218 is thus created between the inner and outer tubes 208 and 214, in the central passage 199 outside inner tube 208 and through apertures 205 into the container 36. The beer flow path 220 is through the down tube 203 and the inner tube 208 of the tapper 206.

It should now be readily apparent to those skilled in the art that a novel filling and dispensing valve and package capable of achieving the stated objects of the invention has been provided. The valve incorporates drop-away valve members to prevent excess pressure from building up after the container has been emptied by leaving the valve permanently open, such as when a package incorporating the valve is crushed, and/or blow-by sealing projections for release of excess pressure when the valve is closed. In another form of the invention, a ratchet mechanism is used to allow the valve to be opened and closed several times before it locks in the open position. The valve is simple in construction, so that it is easily fabricated under high volume manufacturing conditions.

It should further be apparent to those skilled in the art that various changes in form and details of the invention as shown and described may be made. For example, the air and beer flow paths of the valves as depicted could be interchanged with minor changes in the construction of the valves and their associated filling heads and tappers. It is intended that such changes be included within the spirit and scope of the claims appended hereto.

What is claimed is:

1. A filling and dispensing valve, which comprises a valve housing having a central passage extending axially through said valve housing, a second passage extending through said valve housing and circumferentially disposed about said first passage, a first valve member configured for sealing engagement of said central passage, and a second, annular valve member configured for sealing of said second passage, said second, annular valve member and said second passage being configured so that said second, annular valve member is urged into sealing position of said second passage by internal pressure in a container on which said filling and dispensing valve is provided, said second, annular valve member and said filling and dispensing valve being configured so that said second, annular valve member will drop away from sealing position of said second passage and out of a fluid flow path including said second passage when the pressure in the container is insufficient to hold said second, annular valve member in sealing position of said second passage to leave said filling and dispensing valve in a permanently open state.

2. The filling and dispensing valve of claim 1 in which said first valve member comprises a poppet in said central passage, said poppet and said filling and dispensing valve also being configured so that said poppet will drop away from said central passage when the pressure in the container is insufficient to hold said poppet in sealing position against said central passage.

3. In combination, a container for a liquid, said container having a necked opening, and a filling and dispensing valve, which comprises a valve housing having a central passage extending axially through said valve housing, a second passage extending through said valve housing, a valve member configured for sealing engagement of said central passage, said valve member being configured so that said valve member is urged into sealing engagement with said central passage by internal pressure in a container on which said valve is provided, said valve member having at least one flexible, flared projection extending laterally from said valve member and away from an end of said valve configured for placement inside a container, said at least one flexible, flared projection being configured to engage a wall of said central passage in the sealing engagement up to a given pressure in the container and to flex away from the wall at a pressure greater than the given pressure, said filling and dispensing valve being mounted over the necked opening of said container.

4. A filling and dispensing valve, which comprises a valve housing having a central passage extending axially through said valve housing, a second passage extending through said valve housing, a first valve member configured for sealing engagement of said central passage, and a second valve member configured for sealing engagement of said second passage, at least one of said first and second valve members and at least one of said central and second passages being configured so that said at least one of said first and second valve members is urged into sealing engagement of at least one of said central and second passages by internal pressure in a container on which said filling and dispensing valve is provided, said first valve member comprising a poppet in said central passage, said poppet and said central passage being configured so that said poppet will drop away from said central passage when the pressure in the container is insufficient to hold said poppet in sealing position against said central passage, each of said first and second valve members having at least one flexible, flared projection extending laterally and away from an end of said filling and dispensing valve configured for placement inside a container, said at least one flexible, flared projection being configured to engage a wall of one of said central and second passages in the sealing engagement up to a given pressure in the container and to flex away from the wall at a pressure greater than the given pressure.

5. The filling and dispensing valve of claim 4 in which said second passage is connected to said central passage by a plurality of apertures circumferentially positioned around part of said central passage.

6. A filling and dispensing valve, which comprises a valve housing having a central passage extending axially through said valve housing, a second passage extending through said valve housing, a first valve member configured for sealing engagement of said central passage, and a second valve member configured for sealing engagement of said second passage, at least one of said first and second valve members and said filling and dispensing valve being configured so that said at least one of said first and second valve members is urged into sealing engagement of at least one of said central and second passages by internal pressure in a container on which said filling and dispensing valve is provided, at least one of said first and second valve members and said filling and dispensing valve being configured so that said at least one of said first and second valve members will drop away from said at least one of said central and second passages when the pressure in the container is insufficient to hold said at least one of said first and second valve members in sealing position against said at least one of said central and second passages to leave said value in a permanently open state, at least one of said first and second valve members having at least one flexible, flared projection extending laterally and away from an end of said filling and dispensing valve configured for placement inside a container, said at least one flexible, flared projection being configured to engage a wall of one of said central and second passages in the sealing engagement up to a given pressure in the container and to flex away from the wall at a pressure greater than the given pressure.

7. In combination, a container for a liquid, said container having a necked opening, and a filling and dispensing valve, which comprises a valve housing having a central passage extending axially through said valve housing, a second passage disposed circumferentially around said central passage and extending through said valve housing, a first valve member configured for sealing engagement of said central passage, and a second, annular valve member configured for sealing engagement of said second passage, said second, annular valve member and said filling and dispensing valve being configured so that said second, annular valve member is urged into sealing engagement of said second passage by internal pressure in said container, said second, annular valve member and said filling and dispensing valve being configured so that said second, annular valve member will drop away from said second passage and out of a fluid flow path including said second passage when the pressure in the container is insufficient to hold said second, annular valve member in sealing position of said second passage to leave said filling and dispensing valve in a permanently open state, said filling and dispensing valve being mounted over the necked opening of said container.

8. The combination of claim 7 additionally comprising a fluid transfer head configured to separate said central and second passages attached to said valve.

9. The combination of claim 8 in which said fluid transfer head is a filling head configured to supply a liquid for filling the container to one of said central and said second passages and to receive air through another of said central and said second passages displaced from the container as the container is filled with the liquid.

10. The combination of claim 8 in which said fluid transfer head is a tapper for dispensing liquid from the container configured to dispense the liquid from the container through one of said central and said second passages and to supply a gas under pressure to said container through another of said central and said second passages for driving the liquid from the container.

11. A filling and dispensing valve, which comprises a valve housing having a central passage extending axially through said valve housing, a second passage extending through said valve housing and circumferentially disposed about said first passage, a first valve member configured for sealing of said central passage, a second, annular valve member configured for sealing of said second passage, said first valve member and said second, annular valve member being configured so that said first valve member is urged into sealing position of said central passage and said second, annular valve member is urged into sealing position of said second passage by internal pressure in a container on which said filling and dispensing valve is provided, said first valve member, said second, annular valve member and said filling and dispensing valve being configured so that said first valve member will drop away from sealing position of said central passage and said second, annular valve member will drop away from sealing position of said second passage and out of a fluid flow path including said second passage when the pressure in the container is insufficient to hold said first valve member in sealing position of said central passage and said second, annular valve member in sealing position of said second passage, to leave said filling and dispensing valve in a permanently open state.

12. The filling and dispensing valve in claim 11 in which said second passage is connected to said central passage by a plurality of apertures circumferentially positioned around part of said central passage.

13. In combination, a container for a liquid, said container having a necked opening, and a filling and dispensing valve, which comprises a valve housing having a central passage extending axially through said valve housing, a second passage extending through said valve housing and circumferentially disposed about said first passage, a first valve member configured for sealing engagement of said central passage, a second, annular valve member configured for sealing engagement of said second passage, said first valve member and said second, annular valve member being configured so that said first valve member is urged into sealing engagement of said central passage and said second, annular valve member is urged into sealing engagement of said second passage by internal pressure in a container on which said filling and dispensing valve is provided, said first valve member, said second, annular valve member and said filling and dispensing valve being configured so that said first valve member will drop away from sealing engagement of said central passage and said second, annular valve member will drop away from sealing engagement of said second passage and out of a fluid flow path including said second passage when the pressure in the container is insufficient to hold said first valve member in sealing position of said central passage and said second, annular valve member in sealing position of said second passage to leave said filling and dispensing valve in a permanently open state, said filling and dispensing valve being mounted over the necked opening of said container.

14. The combination of claim 13 additionally comprising a fluid transfer head configured to separate said central and second passages attached to said valve.

15. The combination of claim 14 in which said fluid transfer head is a tapper for dispensing liquid from the container configured to dispense the liquid from the container through one of said central and said second passages and to supply a gas under pressure to said container through another of said central and said second passages for driving the liquid from the container.

16. A filling and dispensing valve, which comprises a valve housing having a central passage extending axially through said valve housing, a second passage extending through said valve housing, a valve member configured for sealing engagement of said central passage, said valve member being configured so that said valve member is urged into sealing engagement with said central passage by internal pressure in a container on which said valve is provided, said valve member having at least one flexible, flared projection extending laterally from said valve member and away from an end of said valve configured for placement inside a container, said at least one flexible, flared projection being configured to engage a wall of said central passage in the sealing engagement up to a given pressure in the container and to flex away from the wall at a pressure greater than the given pressure.

17. The filling and dispensing valve of claim 16 in which said valve has a second valve member engaging said second passage in sealing engagement, said second valve member having at least one flexible, flared projection extending laterally and away from the end of said valve configured for placement inside the container, said, at least one flexible, flared projection of said second valve member being configured to engage a wall of said second passage in the sealing engagement up to a given pressure in the container and to flex away from the wall at a pressure greater than the given pressure.

* * * * *